US006431083B1

(12) United States Patent
Carstensen et al.

(10) Patent No.: US 6,431,083 B1
(45) Date of Patent: Aug. 13, 2002

(54) RAIL VEHICLE WITH A FIBER COMPOSITE MATERIAL HEAD MODULE

(75) Inventors: Hartmut Carstensen, Berlin; Bernd Hoppe, Lehnitz; Ursula Wagner, Hennigsdorf; Burkhart Liesenberg, Glienicke; Erwin Schmelzer, Seevetal, all of (DE)

(73) Assignee: DaimlerChrysler Rail Systems GmbH, Berlin (DE)

( * ) Notice: Subject to any disclaimer, the term of this patent is extended or adjusted under 35 U.S.C. 154(b) by 0 days.

(21) Appl. No.: 09/445,756

(22) PCT Filed: Jun. 12, 1998

(86) PCT No.: PCT/DE98/01658

§ 371 (c)(1),
(2), (4) Date: Aug. 8, 2000

(87) PCT Pub. No.: WO98/56634

PCT Pub. Date: Dec. 17, 1998

(30) Foreign Application Priority Data

Jun. 13, 1997 (DE) ..... 197 25 905

(51) Int. Cl.[7] ..... B61D 17/00

(52) U.S. Cl. ..... 105/238.1; 105/396; 105/412; 105/456; 296/29

(58) Field of Search ..... 105/238.1, 329.1, 105/396, 397, 401, 412, 456; 296/29; 403/408.1, 256, 263, 260

(56) References Cited

U.S. PATENT DOCUMENTS 1,299,999 A * 4/1919 Paffenbarger ..... 296/29

(List continued on next page.)

FOREIGN PATENT DOCUMENTS

| | | | | |
|---|---|---|---|---|
| DE | 1088527 B | | 9/1960 | |
| DE | 3740401 A1 | * | 6/1989 | ..... B62D/27/00 |
| DE | 573384 A1 | * | 5/1993 | ..... B61D/17/04 |
| EP | 0533582 A1 | * | 3/1993 | |
| EP | 0573384 A | | 12/1993 | |
| EP | 0630789 A | | 12/1994 | |
| EP | 0836976 A1 | * | 10/1996 | |
| EP | 0836976 A1 | * | 10/1997 | |
| GB | 533582 A1 | * | 3/1993 | ..... B61C/17/04 |

*Primary Examiner*—S. Joseph Morano
*Assistant Examiner*—Frantz F. Jules
(74) *Attorney, Agent, or Firm*—Venable; Norman N. Kunitz

(57) ABSTRACT

The subject matter of the invention is a rail vehicle with a head module made of a composite fiber material. For this, a joining region with height-tolerance compensating means (5) is arranged on the underframe (3) and a joining edge with longitudinal and lateral tolerance compensating means (7 and 8) is arranged on the wagon body module (2). The head module has joining edges that point toward the wagon body module (2) and the underframe (3) and is provided with reinforced sections (18, 19) that are integrated into the fiber composite material. The head module is attached to the underframe (3) and at least at the head module side walls (14) of the wagon body module (2) by means of fastening means (20, 21), which build up a pre-tensioning force, in such a way that shear-resistant connections are created. As a result, it is possible to control size deviations resulting from the production methods in order to avoid undefined internal stresses during the joining, to absorb without damage the differing heat expansions of a head module of fiber composite material and a wagon body module, as well as to produce the head modules of a fiber composite material and the connections of said modules to the wagon body module (2) and the underframe (3) so as to be not only self-supporting but also load-sharing and easy to repair.

12 Claims, 3 Drawing Sheets

U.S. PATENT DOCUMENTS 2,504,656 A * 4/1950 Dean ..... 105/397
3,968,989 A * 7/1976 Schippers ..... 296/29
5,042,395 A * 8/1991 Wackerle et al. ..... 105/397
5,140,913 A * 8/1992 Takeichi et al. ..... 105/397
5,271,687 A * 12/1993 Holka et al. ..... 403/233
5,324,133 A * 6/1994 Kreis et al. ..... 403/270
5,338,080 A * 8/1994 Janotik et al. ..... 296/29
5,472,290 A * 12/1995 Hulls ..... 403/407.1
5,595,123 A * 1/1997 Tao et al. ..... 105/396
5,784,970 A * 7/1998 Fehr et al. ..... 105/401
6,092,473 A * 7/2000 Altenburg et al. ..... 105/404
6,234,084 B1 * 5/2001 Neubauer et al. ..... 105/396

* cited by examiner

RAIL VEHICLE WITH A FIBER COMPOSITE MATERIAL HEAD MODULE

BACKGROUND OF THE INVENTION

The invention relates to a rail vehicle with a head module made of a fiber composite material.

In order to improve the mass balance of rail vehicles, obtain a high degree of design freedom and be able to make use of the technological advantages of fiber composite materials as well as a modular construction with a high degree of prefabrication and pre-testing, rail vehicles are increasingly designed with head modules, e.g. driver's cabins, made of fiber composite materials.

A vehicle of this type is already known from European Patent 0 533 582 B1. According to this patent, a driver's cabin of a rail vehicle is produced as a separate structural component made of a fiber composite material, wherein the walls of the driver's cabin are formed as a single unit together with a support structure for the engineer's console. The driver's cabin must be screwed to the underframe of the rail vehicle, as well as to the upper longitudinal supports of the upper frame for the side wall. If necessary, meaning presumably to compensate tolerances and reduce power peaks, the cabin must be attached by means of elastic buffers. It should be possible to transfer frontally attacking forces that result from a lifting of the vehicle via fixed end stops to the underframe and the upper longitudinal supports. However, there is no mention in this reference of how the joints between the driver's cabin on the one hand and the underframe and the upper longitudinal supports on the other hand are to be designed. It appears to be a disadvantage that specific areas of the driver's cabin must be specially reinforced, owing to the quasi point-type introduction of force into the upper longitudinal supports, and that other areas of the driver's cabin cannot share in this force introduction. As a result, the driver's cabin has an inhomogeneous structure, which causes particular technological difficulties and costs. In addition, this technical concept restricts the load sharing by the driver's cabin for the following extraordinary cases lifting of the rail vehicle for depositing it on the rails;

frontal wall pressure (e.g. 300 kN);

center coupling pressure (e.g. 1500 kN);

center coupling pull (e.g. 1000 kN), for which the wagon body structure of a rail vehicle must be designed. Based on the standard solutions used so far, it is necessary to have an especially rigid design for the remaining wagon body structure with the underframe and the upper longitudinal supports, which results in additional production expenditures and an undesirable mass increase. This relation becomes less favorable, the higher the share of a head module length, relative to the total vehicle length.

Another rail vehicle with a driver's cabin of fiber composite material is described in the magazine "Schweizer Eisenbahn Revue" [Swiss Railroad Magazine] No. 12/1991, pages 436–442 (Cortesi, A.; Issenmann, T.; Kalbermatten, T.de: "Leichte Nasen für schnelle Lokomotiven" [Lightweight Noses for Fast Lokomotives]). In that case, a driver's cabin is constructed in the manner of a sandwich from several structural parts, which are joined with structural glue connections. The driver's cabin is designed as self-supporting unit and thus cannot take over any essential load shares for the above-mentioned extraordinary load cases. This is taken into account through the type of connection used for the underframe and the wagon body as well as their mechanical strength and low rigidity. In order to balance production tolerances of 1 to 5 mm, to ensure a pressure seal and resistance to weather conditions in the joint regions, to absorb strong differences in the heat expansion between the driver's cabin of synthetic material and the metal wagon body module and to ensure a high life expectancy, the driver's cabin is glued on with elastic adhesive, wherein elastic buffers are inserted as spacers between cabin and underframe and unavoidable production tolerances in the glue joint thickness of 10 mm are absorbed. Such a design is totally unsuitable for the case where the head module of a rail vehicle must be designed to be not only self-supporting, but also load-sharing and must be connected rigidly and fixedly with the remaining wagon body structure.

Another solution for a rail vehicle with a separately produced and mounted head module is described in German Patent 43 43 800 A1. This head module is also designed as self-supporting unit and, by integrating all 6 degrees of freedom, must be connected detachably and frictionally with the underframe and must be connected via elastic intermediate members to the wagon body. This solution also cannot assume essential load shares of the wagon body structure and requires a high degree of precision, with respect to the exact fit of the bolts/holes connecting points to the underframe, at different axial positions. Since the connecting points to the underframe are located inside the driver's cabin and must be accessible, it is not possible to achieve a high degree of prefabrication.

SUMMARY OF THE INVENTION

It is the object of the invention to find a solution for a rail vehicle of the generic type, which avoids the disadvantages described in prior art and fixedly connects a head module of fiber composite material in a new way with a wagon body module and an underframe. In the process, production-related form tolerances and size tolerances (relative to the rail vehicle) are to be compensated simply and with little expenditure in vertical, longitudinal and lateral direction between a head module of fiber composite material on the one hand and the wagon body module and underframe on the other hand. Also, no undefined internal stresses must develop during the joining and the varied heat expansions of a head module of fiber composite material and a wagon body module must be absorbed without damage.

The object of the invention furthermore is to design the head module of fiber composite material to be load-sharing and to connect it to a wagon body module that is connected to an underframe, in such a way that a particularly force-locking, fixed and rigid connection is formed between head module and wagon body module as well as underframe and that the head module consequently can share essential loads, corresponding to the aforementioned load cases and the operational stress, and can introduce these into the wagon body structure.

These objects are solved with a rail vehicle of the type having a prefabricated wagon body module that is connected to an underframe, as well as a prefabricated head module made of a fiber composite material, and including at least a frame wall and side walls and wherein: a joining region of the underframe that points toward the head module is provided with height tolerance-compensating means to compensate for height tolerances of the combination of the head module and the underframe; a joining region of the wagon body module that points toward the head module is provided with joining edges with longitudinal and lateral tolerance compensating means e.g., joining web 7, at least in the region of wagon body side walls (9), to compensate for longitudinal and lateral tolerances of the combination of the wagon body module and the head module; the head module has respective joining edges for the head module front wall and for the head module side walls, which point toward the wagon body module and the underframe, that have respective reinforced sections that are integrated into the fiber composite material; the head module front wall and a the head module side walls are connected shear resistant to the underframe by respective fastening means that are tightened against the respective reinforced sections and build up pre-tensioning; and at least the head module side walls are connected shear resistant at least to the wagon body side walls with the aid of fastening means that are tightened against the respective reinforced section and build up pre-tensioning. Advantageous embodiments and modifications of the invention are disclosed.

The embodiment according to the invention of the head module joints opposite those for the wagon body module and underframe makes it possible to create a fixed connection that is free of undefined internal stresses between a head module and a wagon body module as well as an underframe. With this connection, production-related size deviations of the head module as well as production tolerances in the wagon body module and underframe are compensated in a vertical, longitudinal and lateral direction of the vehicle and in a technically simple and economic manner.

Even simple is the compensation of tolerances between the head module and the wagon body module if the solution discovered for a shear-resistant connection is used only in the side wall regions and an elastic glue joint is created in the roof region, in a manner known per se, which joint can also compensate height differences.

The connection between side wall end sections and a wagon body end section according to one modification of the invention reduces expenditure and costs for compensating the tolerances in the wagon body module.

As a result of the low accuracy requirements, head modules and rail vehicles can now be produced more cost-effectively.

Another advantage is that the connection, made in the cold joining technique, does not depend on whether the wagon body module has a steel design, lightweight metal design or any other type of design. This type of connection can be detached for repairs without damaging the head module and the wagon body module.

Another essential advantage achieved with the invention is that it is now possible to produce rail vehicles with head modules made of fiber-reinforced materials, for which the load-sharing head module also takes on load shares of the wagon body frame and can introduce these into the adjacent wagon body module through a fixed and rigid connecting joint.

A high shear resistance is achieved, particularly as a result of the double-shearing connection, at least between the side walls and the head module and wagon body module. Thus, the side walls as well as the head module and the wagon body module can be dimensioned so as to save material and mass. This is supported by the fact that the reinforced sections of the head module, which are integrated along the joining edge and which support the fastening means, absorb the pre-tensioning forces and loads that are transmitted via the joining surfaces between underframe and head module and further transmit these planar to the neighboring fiber composite material, so that a point-type overload or the need for over-dimensioning this material is avoided.

Since the joint connection to the underframe can be established on one side, below the underframe, a head module according to the invention can be produced, equipped and pre-tested with a high degree of prefabrication before it is joined to the wagon body module.

An exemplary embodiment according to the invention, which should not be viewed as limiting, is illustrated and described in the drawings.;

DESCRIPTION OF THE PREFERRED EMBODIMENTS

Figure 1:
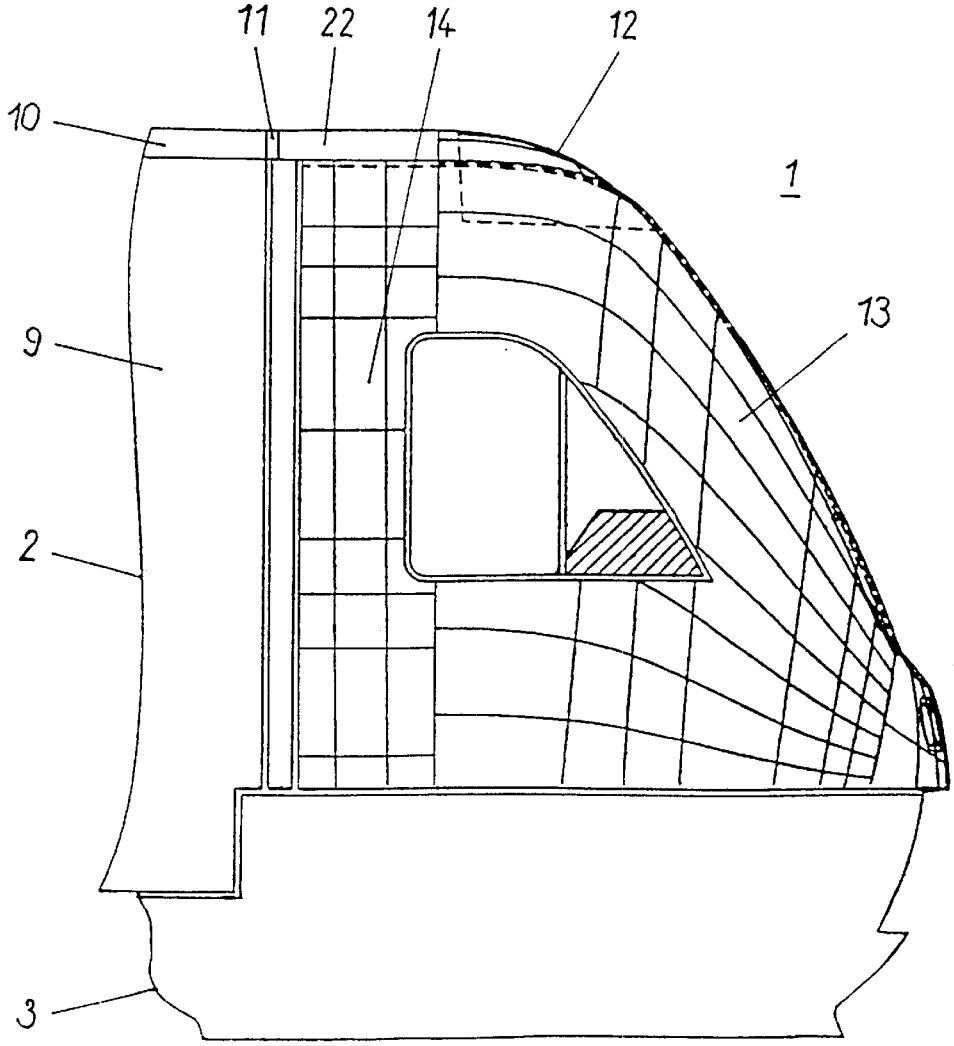
FIG. 1 is a side view of a rail vehicle, designed and joined according to the invention.

According to FIG. 1, a wagon body module 2 for a rail vehicle 1 on an underframe 3 is prefabricated. The underframe 3 accommodates the (not shown here) traction devices and compression devices of the rail vehicle, contains the recesses for wheelsets or bogies (which are also not shown), as well as additional functional units of the rail vehicle and is provided with a partial outer covering for functional and design reasons. According to the exemplary embodiment, the head module 12 consists of at least one head module front wall 13, two head module side walls 14 and one head module roof 22, which can be individually prefabricated and then joined to form the head module 12 or can be produced jointly as one unit to form the head module 12.

Figure 2:
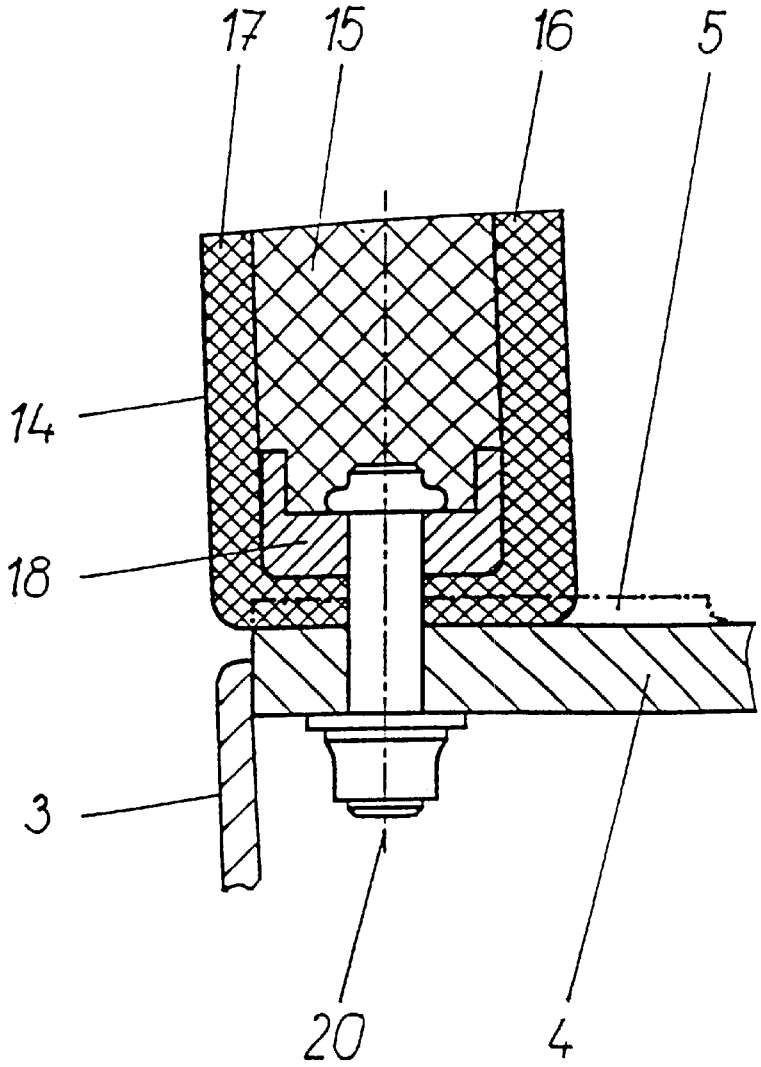
FIG. 2 is a cross section through a joint between head module and underframe.

In order to be able to combine the head module 12 with the underframe 3 in a nearly horizontal joining plane (which can also be inclined, curved and/or graduated) and in the process be able to correct size deviations, a material overmeasure is provided according to FIG. 2 on the longitudinal support 4 of the underframe 3, as means 5 for compensating height tolerances. This overmeasure is mechanically worked off as needed after the prefabricated head module 12 and the underframe have been measured. However, it is also conceivable that one or more height-difference adapted additional shims are provided in place of the material overmeasure of longitudinal support 4, which can also have the form of a U-shaped section that encircles the head module joint edge. It is furthermore possible to use different types of height-tolerance compensating means. The shape of the material overmeasure, shown in FIG. 2, which can be an integral part of the extruded section for a longitudinal support 4 made of lightweight metal, permits a visual control when mechanically working off the material overmeasure. This is designed to avoid engaging in the material region of longitudinal support 4, which is necessary for the stability. Following adaptation of the longitudinal support 4 to the finished dimensions of the head module 12 and after fitting on the head module, the required number of bores are inserted from the underside of the longitudinal support 4 at the required locations, which engage in the joining edge of the head module side wall 14 and penetrate the therein integrated reinforced section 18. Based on the exemplary embodiment, this section has a U-shaped cross section and is arranged inside the sandwich structure of the head module side wall 14, composed of core 15 and laminated structures 16 and 17. According to the exemplary embodiment, blind rivets that can be seated from one side are inserted into these bores as fastening means 20 and are braced between the inside surface of the reinforced section 18 and the underside of the longitudinal support 4, so that the head module side wall 14 and the underframe 3 are frictionally and rigidly connected with pre-tensioning. It makes sense if the form and strength of the reinforced section 18 are dimensioned such that during the transport and assembly the stability of the head module side wall 14 is supported and, following the seating of the fastening means 18, tensional forces as well as load forces are introduced sufficiently planar in longitudinal, lateral and vertical directions into the fiber composite material of the head module side wall 14.

Insofar as the forces that must be transmitted at the join between the head module side wall 14 and the longitudinal support 4 can be transmitted through frictional engagement, the bore diameter can have a large dimension. However, if the joining location must be designed for forces that can be transmitted only through a combination of frictional contact and pressure on the face of a hole, then the bore diameters must have smaller design tolerances relative to the shaft diameter of the fastening means 20.

Based on the exemplary embodiment, the joint between the head module front wall 13 and the underframe 3 mush have an identical design (not shown in further detail in the illustration.)

Insofar as the forces that must be transmitted at the joint between head module side wall 14 and longitudinal support 4 can be transmitted through frictional engagement, the bore diameter can have a large dimension. However, if the joining location must be designed for forces that can be transmitted only through a combination of frictional contact and pressure on the face of a hole, then the bore diameters must have smaller design tolerances relative to the shaft diameter of the fastening means 20.

Based on the exemplary embodiment, the joint between head module front wall 13 and underframe 3 must have an identical design (not shown in further detail in the illustration).

Figure 3:
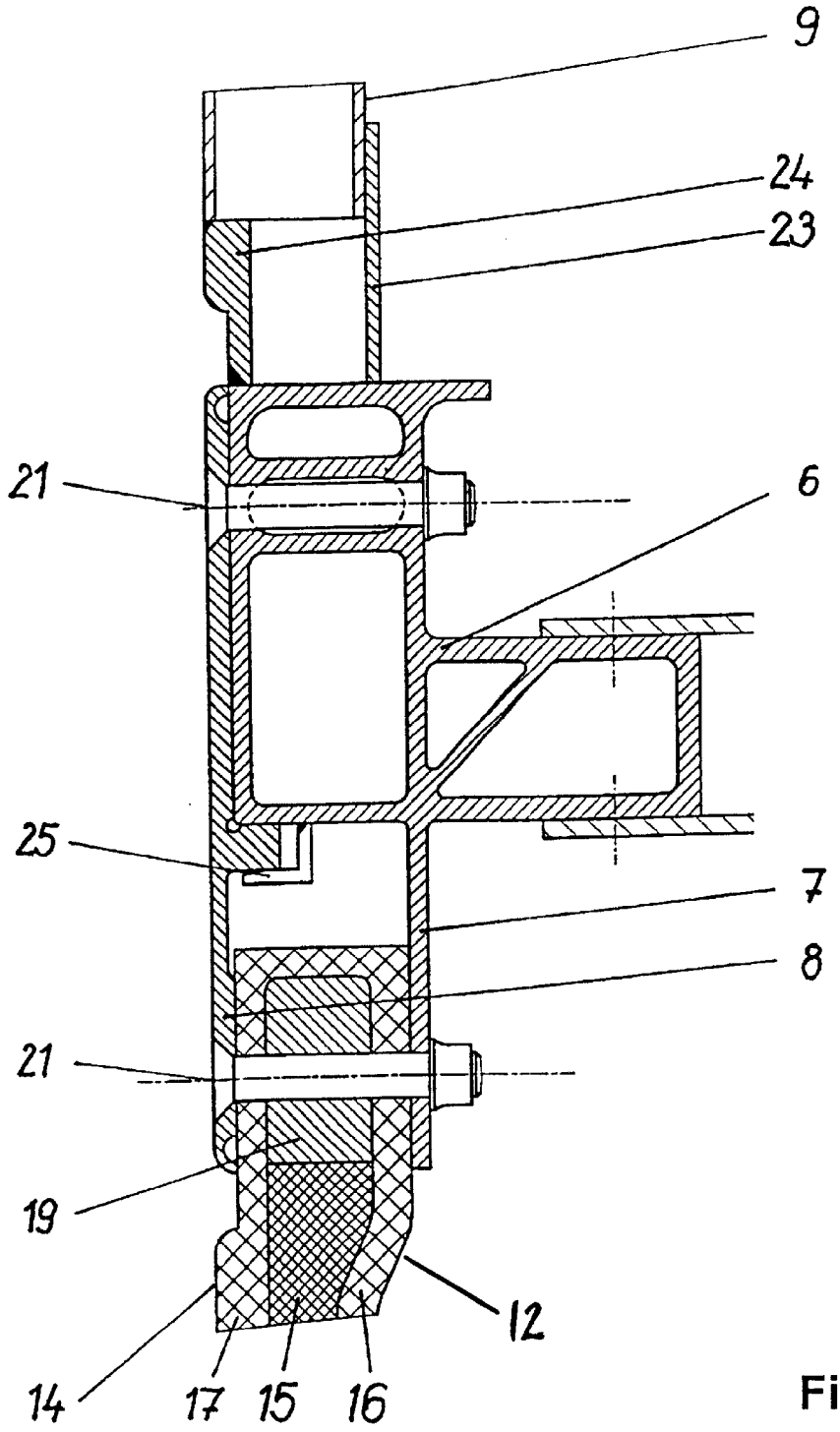
FIG. 3 is a cross section through a joint between head module side wall and wagon body side wall.

FIG. 3 shows that in order to connect the head module 12 in a nearly vertical joining plane (which can also be inclined, curved and/or graduated) with the wagon body module 2, the wagon body side wall 9 in this joining location has an inner joining web 7 and an outer joining web 8, between which the head module side wall 14 is inserted. The leg length of the two joining webs 7 and 8, their distance and elasticity in vehicle lateral direction are selected such that the joining edge of the head module side wall 14, into which a reinforced section 19 is integrated, is enclosed form-locking and that its size deviations in vehicle longitudinal direction and vehicle lateral direction are taken into account. Joint through bores are worked into the joining webs 7 and 8 and the head module side wall 14. According to the exemplary embodiment, lock washer bolts that can be seated from two sides and which create a pre-tensioning are inserted into these through bores as fastening means 21 and are tightened against the reinforced section 19. The above statements concerning the joining location between head module side wall and underframe also apply to the diameter of this through bore. Such a double-shearing design of the joining location provides a frictionally engaged and particularly rigid connection between the head module side wall 14 and the wagon body side wall 9, wherein the fastening means 21 is designed to fit flush with the surface of the outer web 8 and is visually unobtrusive.

The joining location between head module roof 22 and wagon body roof 10 can be designed in the same way. Given sufficient rigidity in the side wall region, however, it is possible according to one modification of the invention (not shown in the illustration) to design this joint as conventional, elastic glued joint 11, which allows for an easy compensation of additional tolerances in the size of the roof region.

With a rail vehicle according to the invention, having a head module with load-sharing design, it has proven advantageous to design the sandwich structure of the head module front wall 13, the head module side wall 14 and the head module roof 22 such that it has a core 15 of at least one core material, as well as laminated structures 16 and 17 of composite fiber material with aligned fibers, deposited at least on both sides on the core 15, and to design the head module 12 as a single unit. It is particularly advantageous if such a core 15 is produced from a lightweight core material, e.g. a light-construction high-resistance foam. It makes sense for the reinforced sections 18 and 19 to be laminated into the joining edges of the corresponding parts of the head module and to be enclosed by the two layers 16 and 17 if required for the transmittal of the shear forces. However, other forms, arrangements and connections of the reinforced sections 18 and 19 at the joining edges of the head module 12 are also possible. For example, the joining edge of the head module side wall 14 to the wagon body module side wall 9 can be formed as an open joining edge, in which the core material is removed in spots and the reinforced section 19 is inserted only if the forces to be transmitted can be transmitted solely through a frictional connection between the head module side wall 14 that is reinforced with the reinforced section 19 and the two joining webs 7 and 8 or by means of pressure against the hole face in the fiber composite material. Both reinforced sections can be made of a lightweight metal, but can also consist of a different material, provided they are designed such that sufficient mechanical strength and durable corrosion resistance are ensured. They can be provided over the complete length of a joining edge, but can also consist of individual parts that are inserted next to each other or spaced apart.

For the joint between head module side wall 14 and wagon body side wall 9, it is also possible to provide a reinforced section of the type of reinforced section 18 or a hollow section in place of the reinforced section 19. Furthermore, in place of the through bores and fastening means 21 that can be seated from two sides, it is possible to provide bores that are inserted separately from both sides and fastening means 20, which are seated from one side, extend through the side webs of the reinforced section and are blind riveted.

According to another modification of the invention, it is provided that at least one of the joining webs 7 or 8 is designed as separate structural part that can be installed individually on the wagon body module 2. It is particularly advantageous when assembling the wagon body module 2 and the head module 12, if the outer joining web 8 is designed and can be installed separately. Given a varying shape of this component, the outer design of the rail vehicle can be varied.

When realizing this solution, it makes sense to provide mounting aids 25 (FIG. 3) at certain intervals on the wagon body, into which the outer joining web 8 can be inserted during the fitting on and which is held in the mounting position without additional aids, either through a frictional or latch-type connection.

According to another modification of the invention, the wagon body module part that holds the inner and outer joining webs 7 and 8 can be a wagon body end section 6 in the form of an open or closed welded structure. However, it is particularly advantageous and accurate to size if the structure consists of a hollow-chamber lightweight metal extruded profile, which has the form of a portal and is bent to fit the outer contour of the rail vehicle 1 and is fitted onto the underframe 3. Such a profile can be produced with good accuracy and represents an advantageous means for the dimensional adaptation of the wagon body side walls 9 and the wagon body roof 10 during the prefabrication of the wagon body module 2. The portal-shaped wagon body end section 6 can serve as support for an intermediate wall that closes off the head module, as indicated in FIG. 3.

One embodiment of this solution provides that the wagon body side wall 9 is not connected directly to the wagon body end section 6, but by means of the intermediate side wall end sections 23 and 24. Such sections are easier to work off mechanically and to adapt than a complete wagon body side wall, so that an easier and faster adaptation to size is possible despite increased expenditure for the joining. By varying the shape, the side wall end section 24 can easily follow a rail vehicle design that must be changed.

Reference numbers used:

1 rail vehicle
2 wagon body module
3 underframe
4 longitudinal support
5 means for compensating the height tolerances
6 wagon body end section
7 joining web
8 joining web
9 wagon body side wall
10 wagon body roof
11 glued joint
12 head module
13 head module front wall
14 head module side wall
15 core
16 laminated structure
17 laminated structure
18 reinforced section
19 reinforced section
20 fastening means
21 fastening means
22 head module roof
23 side wall end section
24 side wall end section
25 mounting aid

What is claimed is:

1. A rail vehicle with a prefabricated wagon body module that is connected to an underframe, as well as a prefabricated head module made of a fiber composite material, and including at least a front wall and side walls and wherein:

a joining region of the underframe (3) that points toward the head module (12) is provided with height tolerance-compensating means (5) to compensate for height tolerances of the combination of the head module and the underframe;

a joining region of the wagon body module (2) that points toward the head module (12) is provided with joining edges with longitudinal and lateral tolerance compensating means (joining web 7 and joining web 8), at least in the region of wagon body side walls (9), to compensate for longitudinal and lateral tolerances of the combination of the wagon body module and the head module;

the head module (12) has respective joining edges for the head module front wall and for the head module side walls (13,14), which point toward the wagon body module (2) and the underframe (3), that have respective reinforced sections (18, 19) that are integrated into the fiber composite material;

the head module front wall and a the head module side walls (13, 14) are connected shear resistant to the underframe (3) by respective fastening means (20) that are tightened against the respective reinforced sections (18) and build up pre-tensioning; and at least the head module side walls (14) are connected shear resistant at least to the wagon body side walls (9) with the aid of fastening means (21) that are tightened against the respective reinforced section (19) and build up pre-tensioning.

2. A rail vehicle according to claim 1, wherein a shear-resistant connection is created in the joining region between the head module (12) and the wagon body module (2), but only between a wagon body side wall (9) and the head module side wall (14) and that the joining edges of a wagon body roof (10) and the head module roof (22) are designed to form a glued joint and are joined by means of an elastic glued joint (11).

3. A rail vehicle according to claim 1 wherein the fiber composite material of the head module (12) is a sandwich-type laminate, consisting of at least one core material (core 15) and fiber composite materials applied to at least both sides (laminated structures 16 and 17) with aligned fiber structures.

4. A rail vehicle according to claim 3, wherein the reinforced sections (18,19) are laminated into the fiber composite material of the head module (12) and are enclosed by the laminated structures (16 and 17) that are applied to both sides.

5. A rail vehicle according to claim 1, wherein the reinforced section (18, 19) consist of a lightweight metal.

6. A rail vehicle according to claim 1, wherein the height tolerance-compensating means (5) is a material overmeasure of the underframe (3), which must be mechanically worked off.

7. A rail vehicle according to claim 1, wherein the portion of the wagon body module (2) that contains the joining webs (7 and 8) of the longitudinal and lateral tolerance compensation means is a wagon body end section (6).

8. A rail vehicle according to claim 7, wherein the wagon body end section (6) is a hollow-chamber section that is adapted to the outside contour of the rail vehicle (1).

9. A rail vehicle according to claim 8, wherein the wagon body end section (6) is a hollow-chamber lightweight metal extrusion section.

10. A rail vehicle according to claim 7 wherein the portion of the wagon body end section (6) that points away from the head module (12) is designed with longitudinal and lateral tolerance compensating means (side wall end section 23 and side wall end section 24) for the connection.

11. A rail vehicle according to claim 1, wherein at least one joining web forming part of said longitudinal and lateral tolerance comprising means (15) installed as a separate part on the wagon body module (2).

12. A rail according to claim 11, wherein mounting aids (25) are used to place the second joining web in the joining position and to hold the web in this position.

* * * * *